United States Patent [19]

Seitz

[11] Patent Number: 4,995,132

[45] Date of Patent: Feb. 26, 1991

[54] GUIDING DEVICE FOR SPIRAL PIPE CLEANERS

[75] Inventor: Reiner Seitz, Helsa-Eschenstruth, Fed. Rep. of Germany

[73] Assignee: ROWO Rohr und Kanal Reiningungsgeraete GmbH, Hessisch-Lichtenau, Fed. Rep. of Germany

[21] Appl. No.: 372,863

[22] Filed: Jun. 28, 1989

[30] Foreign Application Priority Data

Jun. 28, 1988 [DE] Fed. Rep. of Germany ..... 3821667

[51] Int. Cl.[5] ..... B08B 9/02

[52] U.S. Cl. ..... 15/104.33

[58] Field of Search ..... 15/104.33; 226/52

[56] References Cited

U.S. PATENT DOCUMENTS

| | | | |
|---|---|---|---|
| 2,600,707 | 6/1952 | Turnbaugh | 15/104.33 |
| 3,246,354 | 4/1966 | Cooney et al. | 15/104.33 |
| 3,329,044 | 7/1967 | Singer | 15/104.33 |
| 3,882,565 | 5/1975 | Irwin et al. | 15/104.33 |
| 4,447,926 | 5/1984 | Rothenberger | 15/104.33 |

FOREIGN PATENT DOCUMENTS

| | | | |
|---|---|---|---|
| 1409301 | 10/1975 | United Kingdom | 15/104.33 |

*Primary Examiner*—Edward L. Roberts

*Attorney, Agent, or Firm*—Felfe & Lynch

[57] ABSTRACT

A spiral pipe cleaner including coil sections defined by turns and interspaces is rotatable about its axis by means of a drive machine to thread it through a guide housing 1 with an inlet opening 9 and an outlet opening 10. Several engaging jaws 18, 19, 20 in the housing are received in the interspaces between the individual coil turns, which jaws are distributed on the circumference of the coil axis and axially offset. In order to permit passing coil sections joined by means of couplings, the axial distance of two successive engaging jaws 18, 20 and 20, 19 is larger than half of the distance between the ends of two adjacent coil sections joined by coupling elements. Preferably, the axial distance of two successive engaging jaws 18, 19, 20 is larger than the distance between coil sections. In the preferred embodiment at least one engaging jaw 20 is aligned centrally between two engaging jaws 18, 19 disposed on the other side of the coil axis.

18 Claims, 4 Drawing Sheets

GUIDING DEVICE FOR SPIRAL PIPE CLEANERS

BACKGROUND OF THE INVENTION

Guiding device for spiral pipe cleaners including steel wire coils coiled up with interspaces and rotatable around their axes by means of a drive machine separate from the guiding device. A guiding housing with an inlet opening at one end and an outlet opening for the coil at the other end has several jaws disposed in the guiding housing and positively engaging in the interspaces of the individual turns of the coil. These jaws are distributed on the circumference of the coil axis (A—A) and axially offset corresponding to the inclination of the helix.

Among experts, such cleaning devices are referred to as "spiral cleaners", although, strictly speaking, they are coils which are formed by coiling up a steel wire along a helical line.

Devices to guide coils are known from U.S. Pat. No. 4,447,926. These are tubes, drums or adaptor magazines which serve to hold coils but do not apply any feeding power to these coils.

Operating such devices is very difficult if such a driven spiral pipe cleaner or coil is to be used for a correspondingly long downpipe. The vertical length of such downpipes can indeed exceed 15 to 20 stories which requires a total length of the spiral pipe cleaner of approximately 60 m. During the cleaning process the spiral cleaner is assembled by joining parts together by means of couplings, and during removal of the coil these parts are disassembled again. The parts have a lengths between 4 and 5 meters and, depending on the coil diameter, a weight between 2 and 8 kg. For a total length of 60 m this results in a total weight between approximately 30 and 120 kg. The operator can handle such a weight only with great physical effort or even not at all. This increasingly creates problems when using these pipe cleaning machines with downpipes of great vertical length. It should also be considered that the cleaning coils are wet and/or dirty when they are retracted from the pipe after use which also accounts for difficult handling.

It is known to combine pipe cleaning machines having a driven holding drum during manufacture with an additional feeding device which positively engages in the coil for greater lengths.

According to U.S. Pat. No. 3,246,354, such a drum machine includes a feeding device which is equipped with a special belt drive; the speed of this belt drive is matched to the speed of the drum (differential effect). Such a machine involves a great deal of labor and costs and is difficult to transport.

In an another drum machine according to the U.S. Pat. No. 3,882,565 the advance feed is generated by a jaw chuck and controlled by a manually operated brake which demands total attention of the operator.

Due to large stored coil length, these drum machines do not involve the problem of assembling a long coil of relatively short parts by using couplings. However, what must be accepted is the heavy weight combined with unwieldy shape which must not be underestimated during transport and use as well as the risk of coil breaking; this occurs if the coil gets stuck during use and the drum continues rotating for several more revolutions due to its high moment of inertia.

The advance coupling of the drum machine in accordance with the British Patent No. 1,409,301 does not facilitate the operator's task during retraction of the coil since it is a mere manual device which requires manually compensating the retracting force in any case.

From the U.S. Pat. No. 3,329,044 a guiding device of the aforesaid kind is known, a "passive" device which uses the rotation of the coil generated by a separate drive machine, which is necessary in any case in order to produce a advance feed effect in the one direction and a retraction effect in the other direction, i.e. reverse direction of rotation. However, this device cannot be used with such a pipe cleaning machine where the coil in its entire length is assembled by combining parts by means of couplings. These couplings cannot pass through the guiding device during advance or retraction. Opening the housing so as to pass through the coupling would result in the loss of positive engaging and the coil axially slides through. The axial offset of the engaging elements corresponds only in a fraction to coil inclination since the engaging elements must be disposed on a helical line so as to avoid jamming. Hence, the axial offset of the three engaging elements corresponds just to one third of the coil inclination; this means it amounts only to a few millimeters. Hence, the engaging elements absolutely block the passing of a coupling.

SUMMARY OF THE INVENTION

It is therefore an object of the invention to improve the aforesaid guiding device that it can be used with pipe cleaning machines where, due to reasons of transportation and weight, coils are assembled using parts which are joined by means of couplings.

The object is achieved in that the axial distance between two successive engaging jaws is greater than half of the distance "D" between the ends of two adjacent coil sections, caused by two coupling elements connected to each other. Preferably, the axial distance of two successive engaging jaws is greater than the distance "D."

A particularly advantageous embodiment of the invention is characterized in that at least one engaging jaw disposed on one side of the coil axis is associated with its surfaces engaging at least one interspace of the coil and extending toward the coil axis between at least two engaging jaws disposed on the other side of the coil axis.

The guiding housing including the engaging jaws assumes the function of a nut with respect to the steel wire coil which, in turn, can be considered as a kind of "screw." The operator is not involved in physical efforts.

On the other hand, however, the nut does not function as a block with regard to the couplings. The configuration of the engaging jaws in accordance with the invention permits the coil axis to follow a serpentine line. This is necessary in the moment when a coupling having a cylindrical surface and connecting two partial lengths of the coil passes through the guiding housing. As soon as the coupling hits on one of the engaging jaws, it can laterally escape without neutralizing the positive engagement of the remaining engaging jaws, because the coil axis is not laterally displaced at the remaining engaging jaws. The positive engagement is maintained—as a whole—, i.e. a so-called "sliding through" of the coil through the guiding housing is excluded.

It is an advantage if the axial distance of the engaging jaws is selected with respect to the axis of the housing and the coil so as to be large enough to avoid at any time a simultaneous contact of a coupling by two successive engaging jaws.

It is an additional advantage if the engaging jaws have, in cross section, "T-shaped" configuration parallel to the coil axis; the flange of the "T" serves as a mounting flange and the cross piece supports the engaging surfaces for the coil.

It is another additional advantage if the engaging jaws are provided with paired axially and radially offset engaging surfaces so as to engage with the coils in different diameters and different coil spacings. This permits using the same guiding device for such different coils like the ones with diameters of 22 mm and 32 mm.

Finally, it is particularly advantageous if the engaging surfaces are under a certain angle to the coil axis; this angle corresponds to the angle of inclination of the coil where the latter contacts the respective engaging surface. In the ideal case the engaging surfaces have a complementary form at their point of contact with the coil surface, i.e. the engaging jaws have the effects of a sector of a nut.

It is again of particular advantage if the guiding housing is provided with a block-like chamber having a bottom, lateral sides and a cover and if the engaging jaws are disposed on the bottom and at the cover. If the cover can, in addition, be removed or is pivotably disposed on the guiding housing, the positive engagement can be eliminated at least for the engaging jaws disposed at the cover and the coil can then jump over the engaging jaws disposed on the bottom. The ratio of advance to rotation speed of the coil is thus decoupled.

Finally, the removable or pivotable cover also supports maintenance services such as, applying lubricants. The engaging jaws are considered as wearing parts which must be replaced after longer periods of time. However, in order to compensate the reaction force caused by transverse movements of the coils, removable guiding bars made of a wear resisting material are advantageously disposed on the lateral sides of the guide housing. Through the combined action of all these features the coil is guided within a block-like chamber.

It is finally of a particular advantage if the guide housing has pipe sockets on both ends of the chamber with one of the pipe sockets being configured as a 90° elbow. If, in addition, a removable extension piece is inserted in at least the downward end of the pipe socket which is configured as an elbow, the guiding device itself can be inserted in the orifice of the pipe to be cleaned. This results in an optimum coil guiding during advance and retraction. Moreover, a special rack for the guiding device is thus not required.

DETAILED DESCRIPTION OF THE PREFERRED EMBODIMENT

Figures 1, 2:
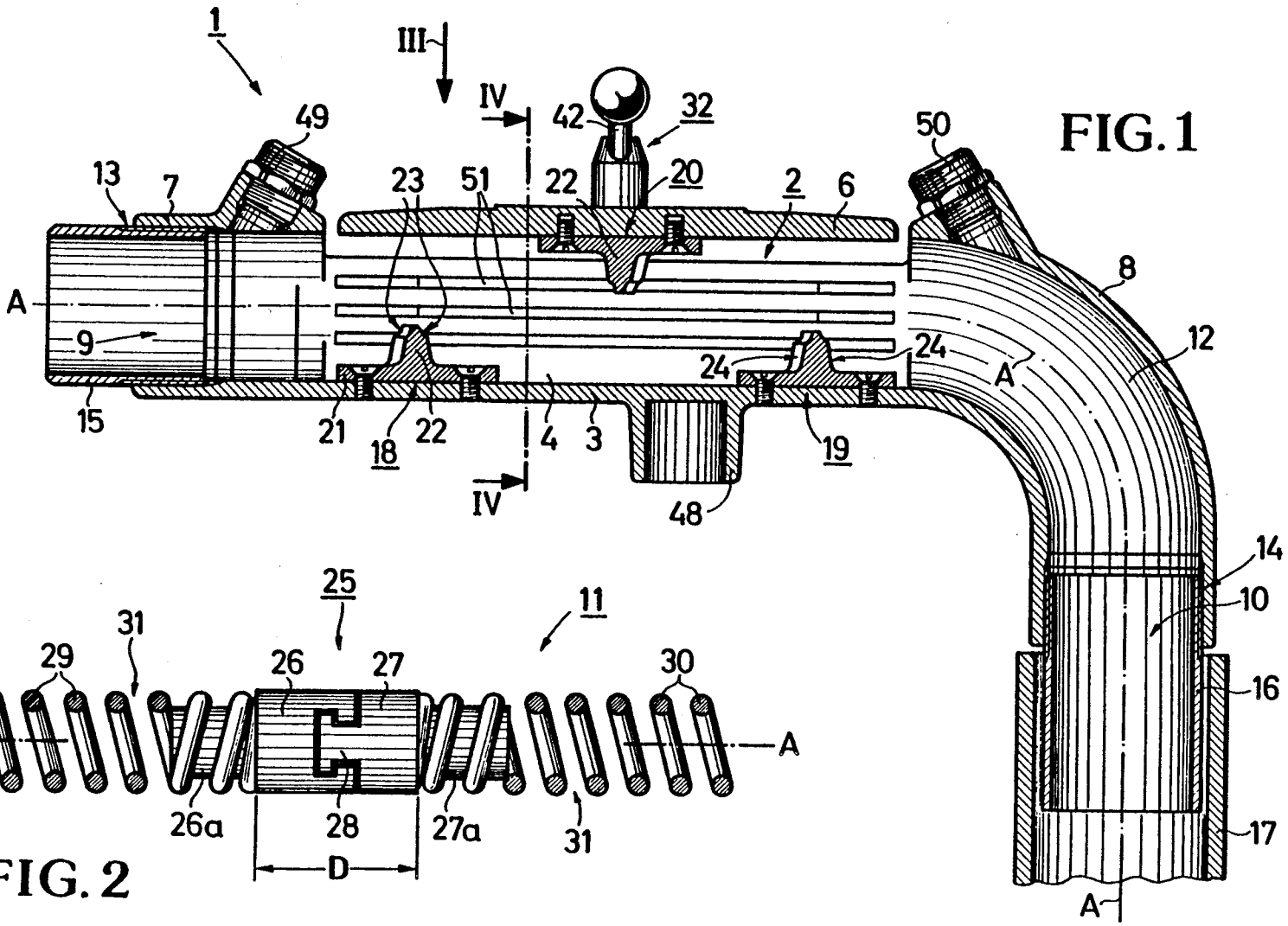
FIG. 1 is a vertical cross section of a guiding device in ready position.
FIG. 2 is partial cross section view of the spiral pipe cleaner including a coupling in enlarged scale.

FIG. 1 illustrates the guiding housing 1, including a block-like chamber 2 which is defined by a bottom 3, two lateral sides 4 and 5 and a cover 6. The chamber is open toward the face sides where it is continued in form of pipe sockets 7 and 8 featuring an inlet opening 9 and an outlet opening 10. These terms were selected with respect to the insertion of the spiral pipe cleaner 11 according to FIG. 2. With regard to the retraction of the coil 11 the reference numerals are, of course, interchangeable.

The pipe socket 8 is configured as a 90° elbow 12, such that the axis of the outlet opening 10 is vertically aligned. At the end of pipe sockets 7 and 8, there are the coupling elements 13 and 14 which are in the present case configured as threads and screwed in the replaceable extension pieces 15 and 16. The axis of the extension piece 15 is horizontal and basically aligned to the drive machine, which is not represented, for the coil 12 according to FIG. 2. The vertical axis of the extension piece 16 is inserted or plugged into the top end of a pipe to be cleaned such that this pipe functions as the (only) mounting for the guiding housing 1.

Two engaging jaws 18 and 19 are mounted to the bottom and an additional engaging jaw 20 is disposed at the cover 6. The jaws are replaceably mounted by mean of flat head screws which are not represented in detail.

The three engaging jaws 18, 19, 20 are arranged such that the two jaws 18 and 19 located successively in direction of the coil axis are disposed on one side (below) the coil axis A—A whereas the third engaging jaw 20 is centered and "matching the gap" on the opposing side (above) the coil axis A—A.

The engaging jaws 18, 19, and 20 each have a T-like configuration in a sectional plane parallel to the coil axis A—A. They are each provided with a flange 21 by means of which they are mounted to the bottom 3 and the cover 6. The cross piece 22 has at its free end paired engaging surfaces 23 for the coils 11. In the present case, the engaging jaws 18, 19, and 20 also have paired engaging surfaces 24 which are offset from surfaces 23, so as to engage coils having different diameter and different coil spacing. This ensures a universal use of the guiding device.

Furthermore, a connecting element 48 for putting on or mounting onto a stand or a support is provided. Two connecting elements 49 and 50 (threaded pipe piece) serve to connect a water pipe, for example to clean a heavily dirty coil during retraction. The cleaning water is drained through pipe 17. Longitudinal ribs 51 parallel to the axis increase the service life with regard to premature wear caused by friction of the coil at the guiding housing (cf. also FIG. 4).

FIG. 2 illustrates a coupling 25 with two coupling parts 26 and 27. The coupling part 27 is provided with a T-like head piece 28 which can be inserted in a complementary, diametrical groove of the coupling part 26. A release of the locking is made possible in that the external surfaces of the coupling parts 26 and 27 are in a common cylindrical surface. Two sections 29 and 30 of a coil 11 or a spiral pipe cleaner are connected to the two coupling parts 26 and 27. The coils are coiled up with a spacing, i.e. the individual turns include interspaces 31 in which the jaws 18, 19, and 20 positively engage with their engaging surfaces 23 or 24.

The ends of two adjacent coil sections 29 and 30 have a certain distance "D" to each other which is occupied by the main segments of the coupling elements 26 and 27. The peg-shaped extension pieces 26a and 27a are not taken into consideration since they are set back in the radius by the diameter of the wire, i.e. far enough. The distance "D" is relevant for the axial distance of the engaging jaws 18, 19, and 20.

From FIG. 1 in connection with FIG. 2 it can be gathered that the composed coil according to FIG. 1 can be inserted in the inlet opening 9 from the left with a proper sense of rotation and, under the appropriate rotation, passed over the engaging jaws 18, 19, and 20. As soon as the coupling 25 hits on the engaging jaw 18 it performs a corresponding upward escape movement. Opening the cover 6 substantially facilitates the insertion of the coil. When the cover 6 is closed the coupling 25 downwardly escapes when it hits on the engaging jaw 20 and the upward escape is repeated. It can be gathered that the coil axis A—A follows different serpentine courses while passing through the chamber 2. However, this does not interfere in any way with the axial advance of the coil 11 in both moving directions.

Figure 3:
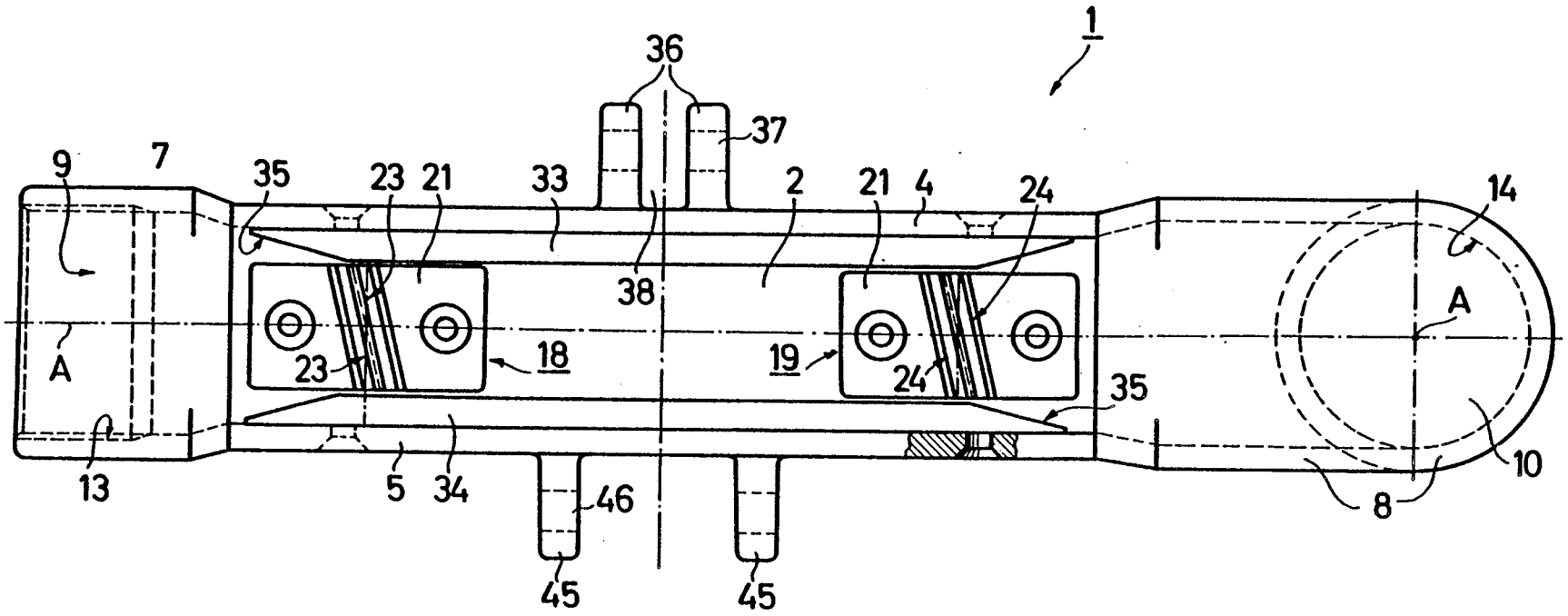
FIG. 3 is a top view of the invention according to FIG. 1 in direction of arrow III, the cover, however, is removed.

It can also be gathered from FIG. 3 that the paired engaging surfaces 23 and 24 are positioned under an angle to the coil axis A—A which is distinct from 90°. This angle does correspond to the angle of inclination of the coil where the latter contacts the respective engaging surface. It is particularly advantageous that the engaging surfaces 23 and 24 are arcuately curved and configured so as to be complementary to the respective immediately adjacent turns of coil 11. The engaging jaws and cross pieces 22 thereof thus act like a thread in a nut.

Furthermore, it can also be gathered that the longitudinal ribs are omitted in this case; instead, the inside surfaces of the lateral walls 4 and 5 are provided with replaceable guiding bars 33 and 34 which are made of a wear resisting material. The guiding bars as well as the longitudinal ribs in FIGS. 1 and 4 prevent a lateral escaping of the coil 11; they are on both ends provided with inclined surfaces so as to prevent a locking of the coupling 25. Flat head screws which are not represented in detail are used to mount the guide bars 33 and 34.

Figure 4:
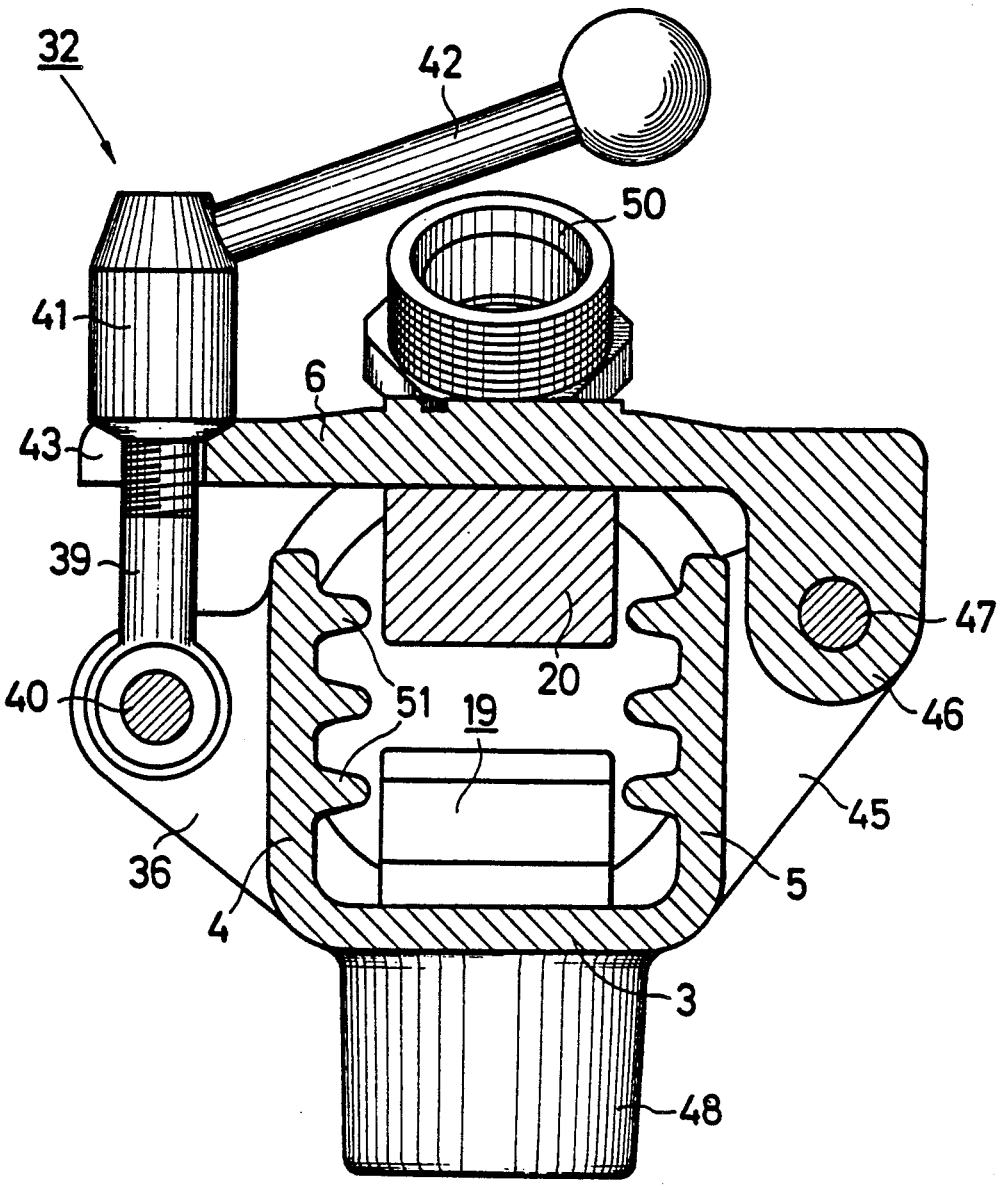
FIG. 4 is a vertical cross section of the invention of FIG. 1 along the line IV—IV is an enlarged scale and FIG. 5 is a partial perspective view of the guiding device while the cover is open.

Two eyelets 36 having the boreholes 37 are cast on the external side of the lateral wall 4 and enclose a space 38. Referring also to FIG. 4, the eye bolt 39 of the locking element 32 is inserted in this space 38 and fastened by a hinge bolt 40. A nut 41 is disposed on the eye bolt 39 by means of a toggle 42 which permits rotating about bolt 40.

Figure 5:
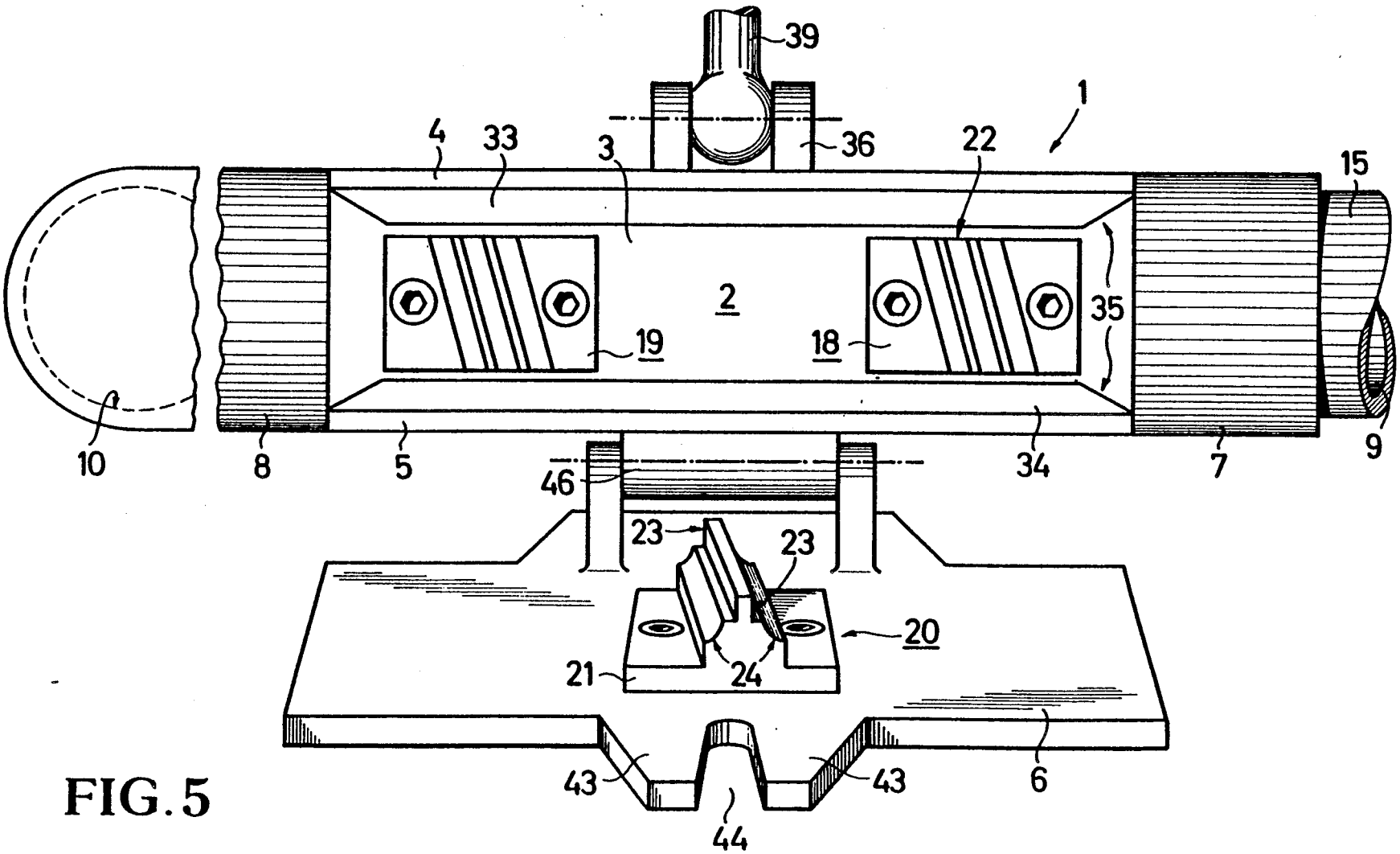

As shown in FIGS. 4 and 5, the nut 41 is supported by two projections 43 of the cover 6; between these projections, there is recess 44 extending up to the rim which receives the eye bolt 39. The cover 6 can thus be firmly pressed downwardly while the toggle 42 is tightened.

At the external side of the opposing lateral wall 5, there are also—with a larger spacing—two eyelets 45 with boreholes 46. A hinge joint to the cover 6 by casting can be inserted between the two eyelets and be fastened by means of an additional hinge bolt 47.

Especially from FIG. 4 it can be gathered that the engaging jaws 18/19 on one side and 20 on the other side form, together with the lateral longitudinal ribs 51, a rectangular frame in the projection; the coil 11 is safely passed through this frame and supported therein. Opening the cover 6 permits at any time eliminating stiff operation (e.g. by lubricating or greasing), monitoring operational conditions and, if necessary, carrying out an assembling or disassembling of a coupling piece 25.

FIG. 5 wherein the connecting elements 49 and 50 are omitted particularly illustrates the good access to chamber 2.

Numerous pipe cleaning tools can be connected to the most external, i.e. bottom end of the coil using the same couplings as represented in FIG. 2. Possible tools are: return drill, helical saw-tooth cutters, square bit, root cutter, swinging chain head, lobed drill, funnel-shaped auger, bladed drill, Widia boring head. Spiral pipe cleaners having a so-called plastic core can also be used.

I claim:

1. Guiding device for a spiral pipe cleaner which is rotated about its axis to thread it through said guiding device, said pipe cleaner being of the type comprising a plurality of coil sections fixed to coupling elements which are connected to space adjacent coil sections apart by a distance D, said coil sections having a common coil axis and a common circumference, each coil section comprising a plurality of turns separated by interspaces, said guiding device comprising a guide housing with opposed openings for receiving said pipe cleaner axially therethrough, said housing having engaging jaws fixed therein which are received in the interspaces and are aligned to positively engage the turns, said jaws being distributed in an axial succession in the housing about the circumference of the pipe cleaner, successive engaging jaws being circumferentially spaced apart, the axial distance between successive engaging jaws being greater than half of the distance D.

2. Guiding device in accordance with claim 1, wherein the axial distance between two successive engaging jaws is greater than the distance D.

3. Guiding device in accordance with claim 1, wherein at least one engaging jaw is located axially between and diametrically opposed from two engaging jaws which are axially aligned.

4. Guiding device in accordance with claim 3 wherein three engaging jaws are provided, two of which are aligned in the direction of the coil axis and the third of which is centered with respect to the first two jaws diametrically opposite said coil axis from said first two jaws.

5. Guiding device in accordance with claim 1 wherein the engaging jaws each have a T-shaped profile in their cross section parallel to the coil axis, each jaw comprising a mounting flange fixed to said housing and a cross piece which engages the turns.

6. Guiding device in accordance with claim 5 wherein the cross piece has engaging surfaces under an angle to the coil axis which corresponds to the angle of inclination of the turns to the coil axis.

7. Guiding device in accordance with claim 1 wherein the engaging jaws each have two pairs of engaging surfaces, the surfaces of each pair being axially and radially offset from the surfaces of the other pair to engage coil sections of different diameter and different turn spacing.

8. Guiding device in accordance with claim 1 wherein the guide housing is provided with a block-like chamber including a bottom, opposed lateral walls, and a cover opposite said bottom, the engaging jaws being disposed on the bottom and on the cover.

9. Guiding device in accordance with claim 8 wherein the lateral walls are provided with replaceable guide bars made of a wear resisting material.

10. Guiding device in accordance with claim 8 wherein the cover can be removed from the guide housing.

11. Guiding device in accordance with claim 10 wherein the cover is attached to one lateral wall of the chamber by means of a hinge and connected to the opposite lateral wall by means of a locking element which can be released.

12. Guiding device in accordance with claim 8 wherein the guide housing has pipe sockets at the openings for receiving the pipe cleaner.

13. Guiding device in accordance with claim 12 wherein the guide housing includes an elbow.

14. Guiding device in accordance with claim 12 wherein one of the pipe sockets is configured as a 90° elbow.

15. Guiding device in accordance with claim 12 further comprising replaceable extension pieces threaded into said pipe sockets.

16. Guiding device in accordance with claim 1 wherein the guide housing is provided internally with longitudinal ribs parallel to the axis.

17. Guiding device in accordance with claim 1 further comprising a connecting element for a support device, said element being disposed on the bottom side of the guide housing.

18. Guiding device in accordance with claim 1 wherein the guide housing is provided with at least one connecting element for connecting a water pipe.

* * * * *

UNITED STATES PATENT AND TRADEMARK OFFICE

CERTIFICATE OF CORRECTION

PATENT NO. : 4,995,132

DATED : February 26, 1991

INVENTOR(S) : Reiner Seitz

It is certified that error appears in the above-identified patent and that said Letters Patent is hereby corrected as shown below:

Column 2, line 30, after "device" insert --so--.

Column 5, line 55, delete "44 extending up to the rim".

Signed and Sealed this

Fifteenth Day of June, 1993

*Attest:*

*Attesting Officer*

Michael K. Kirk

MICHAEL K. KIRK

*Acting Commissioner of Patents and Trademarks*